US009566778B1

(12) United States Patent
Ernst et al.

(10) Patent No.: US 9,566,778 B1
(45) Date of Patent: Feb. 14, 2017

(54) PRINTING SYSTEM INCLUDING A MINIMALIST ENDCAP FOR A CYLINDER

(71) Applicant: NIKE, Inc., Beaverton, OR (US)

(72) Inventors: Travis K. Ernst, Portland, OR (US); Joseph J. Bevier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/959,156

(22) Filed: Dec. 4, 2015

(51) Int. Cl.

| | |
|---|---|
| ***B41F 17/38*** | (2006.01) |
| ***B41J 3/407*** | (2006.01) |
| ***B41F 3/54*** | (2006.01) |
| ***B41F 17/00*** | (2006.01) |

(52) U.S. Cl.
CPC ..... *B41F 3/54* (2013.01); *B41F 17/005* (2013.01); *B41J 3/4078* (2013.01)

(58) Field of Classification Search
CPC ..... B41F 17/005
See application file for complete search history.

(56) References Cited

U.S. PATENT DOCUMENTS

| | | | | |
|---|---|---|---|---|
| 2,199,973 | A * | 5/1940 | Sheeler | B41J 1/32 101/415.1 |
| 2007/0191200 | A1* | 8/2007 | Orlady | F16C 13/00 492/49 |
| 2013/0330696 | A1* | 12/2013 | Berkley | G09B 23/28 434/262 |
| 2014/0299009 | A1 | 10/2014 | Miller et al. | |

* cited by examiner

*Primary Examiner* — Joshua D Zimmerman
(74) *Attorney, Agent, or Firm* — Klarquist Sparkman, LLP

(57) ABSTRACT

An endcap for a cylinder for use in a customization system for tubular articles. The endcap has a minimized geometry to maximize the surface area of the tubular article available for printing. The endcap may be limited in size so that the endcap is limited to an endface of the cylinder. The endcap may also have a shape that limits the amount of material in the endcap, such as an X-shape. The endcap may include a fast connection system such as a plurality of magnets for rapid loading and unloading of the articles on the cylinder.

19 Claims, 13 Drawing Sheets

PRINTING SYSTEM INCLUDING A MINIMALIST ENDCAP FOR A CYLINDER

BACKGROUND

The present invention relates generally to articles of clothing and in particular to a customization system for printing onto tubular articles.

Systems for printing onto three dimensional articles may utilize a structure such as a cylinder as part of the customization system for holding the three dimensional articles, such as in U.S. Patent Application Publication 2014/0299009.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

FIG. 10 is a perspective view of a cylinder for use in a printing system with a tubular article partially positioned on the cylinder;

FIG. 11 is a perspective view of the cylinder of FIG. 10 with the tubular article fully positioned on the cylinder and an endcap aligned with the cylinder;

FIG. 12 is a partial cross-sectional view of the cylinder of FIG. 10 with the tubular article and endcap in position for printing;

FIG. 13 is a perspective view of an embodiment of a printing system incorporating the cylinder of FIG. 10 with the cylinder in a load position relative to the printer;

FIG. 14 is a perspective view of an embodiment of a printing system incorporating the cylinder of FIG. 10 with the cylinder in a use position relative to the printer;

FIG. 15 is a perspective view of an embodiment of a printing system incorporating the cylinder of FIG. 10 with the cylinder is a load position relative to the printer after a graphic has been printed onto the tubular article.

DETAILED DESCRIPTION

Figure 1:
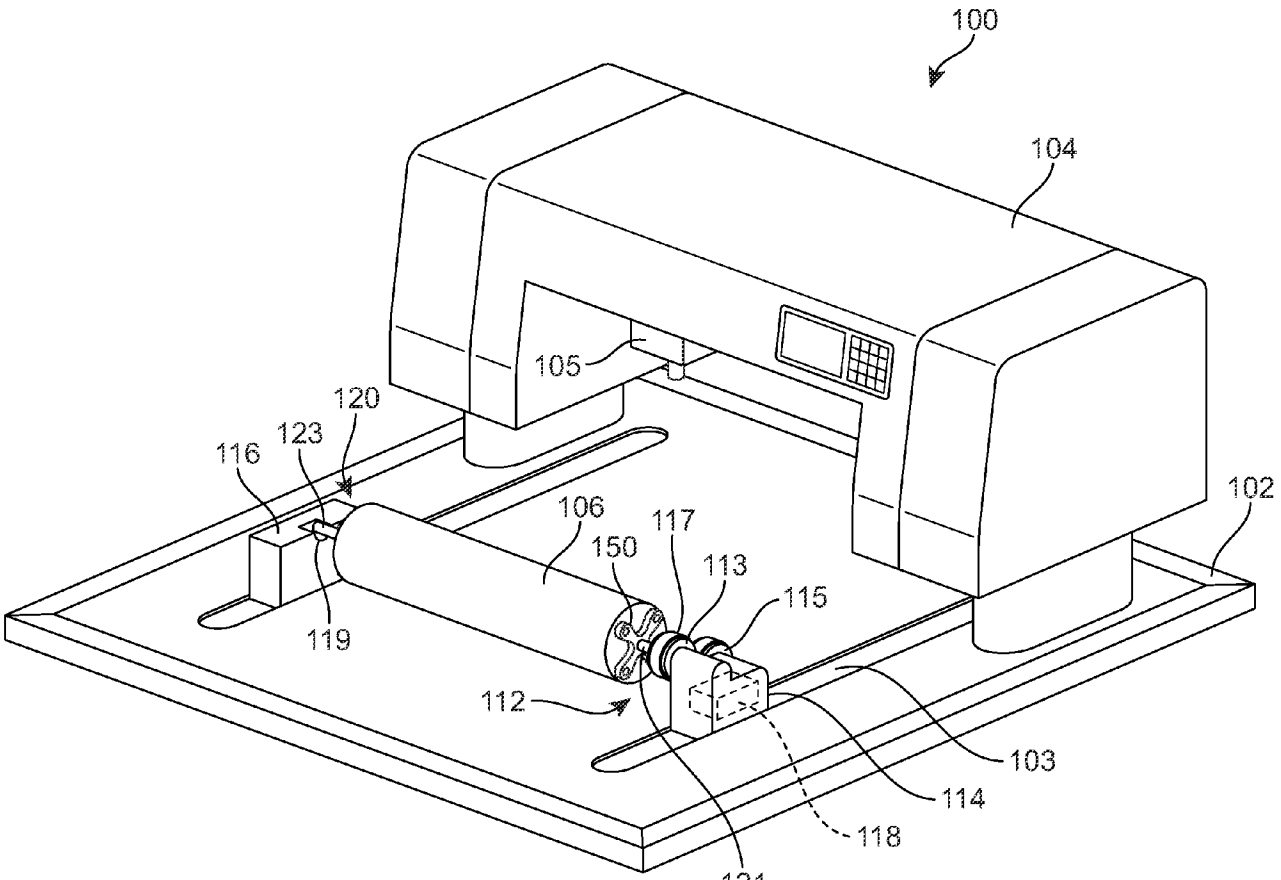
FIG. 1 is a perspective view of an embodiment of a printing system for a tubular article including an embodiment of a cylinder with a removable, minimalist endcap.
Figure 2:
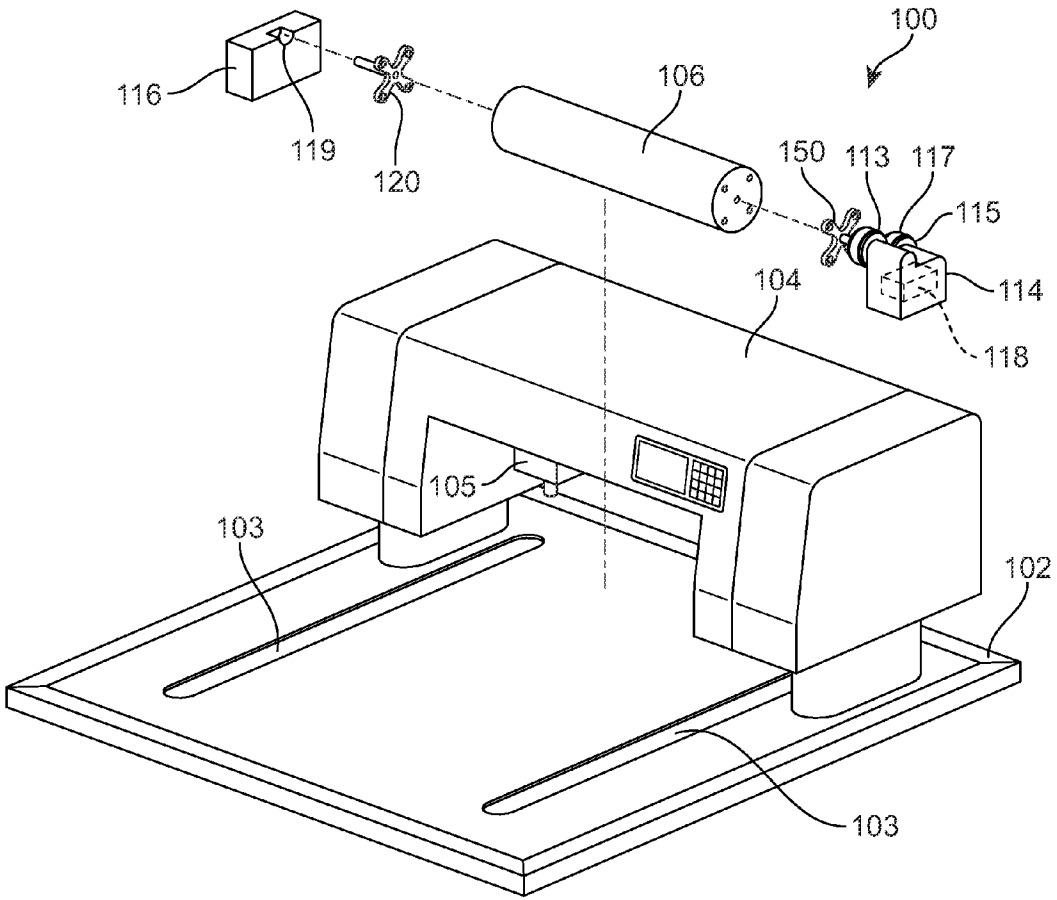
FIG. 2 is a perspective view of the embodiment of the printing system of FIG. 1 with the cylinder, cylinder drive mechanism, and minimalist endcaps shown in an exploded view.

FIGS. 1-15 show a customization system 100 for a three dimensional article such as a tubular article. Customization system 100 may include a printer 104 having at least one print head 105 and a rotatable cylinder 106 for holding the three dimensional article proximate printer 104. Cylinder 106 may also support the three-dimensional article so that the article presents a substantially flat printing surface to minimize possible printing errors. The cylinder can be rotated so that any portion of the tubular article may receive at least a portion of a graphic, including a graphic of any angle up to or in excess of 360 degrees.

In contrast to flat articles or generally rigid articles, articles of clothing or apparel having a generally tubular or cylindrical configuration may pose challenges for presenting a substantially uniform flat surface for printing. Typically, a tubular or cylindrical article may be worn on a portion of a wearer's body that provides support to hold the shape of the article. When removed from the wearer's body, the article may then be in a flat or unsupported configuration. Accordingly, in an exemplary embodiment, customization system 100 may be provided with an apparatus for holding a tubular article to provide a substantially uniform flat surface for printing. In one embodiment, the apparatus for holding the tubular article may be configured as a cylinder 106.

Removable minimalist endcaps, such as first endcap 120 and second endcap 150 may be connected to cylinder 106 to facilitate loading a tubular article such as first article 101 and second article 201 (shown in FIGS. 10-15) onto cylinder 106 and connecting cylinder 106 to customization system 100. In some embodiments, first endcap 120 and second endcap 150 may have a minimized geometry for ease of manipulation of the endcaps and cylinder 106. A minimized geometry may also allow for first endcap 120 and second endcap 150 to be positioned on cylinder 106 without obstructing printing surfaces of article 101. Additionally, endcaps 120 and 150 may be provided with a fast connection system to facilitate loading first article 101 onto cylinder 106 and loading cylinder 106 into customization system 100.

Before describing the specifications of minimalist endcaps 120 and 150, the components of customization system 100 are described to provide context for the use and positioning of minimalist endcaps 120 and 150 with customization system 100. FIG. 1 is a schematic view of an embodiment of customization system 100 employing cylinder 106 with minimalist endcaps such as first endcap 120 and second endcap 150. In some embodiments, customization system 100 may be intended for use with various kinds of articles including apparel and/or footwear. In particular, customization system 100 may include various kinds of provisions for applying graphics, or any type of design or image, to apparel and/or footwear. Moreover, the process of applying graphics may occur after an article has been manufactured. For example, graphics may be applied to an article of clothing after the article of clothing has been manufactured into a three-dimensional form. In other cases, graphics may be applied to an article of clothing, or one or more components of an article of clothing, prior to, and/or during, manufacture. For example, graphics may be applied to a sleeve of a coat or jacket prior to being assembled into a finished article.

The term "graphic" as used throughout this detailed description and in the claims refers to any visual design elements including, but not limited to: photos, logos, text, illustrations, lines, shapes, images of various kinds as well as any combinations of these elements. Moreover, the term "graphic" is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions of an article of clothing.

The term "substantially" as used throughout this detailed description refers to engineering or machining tolerances. For example, any plane or angle discussed herein may include a few additional degrees due to manufacturing limitations. Such tolerances will be familiar to those of ordinary skill in the art.

For clarity, the following detailed description discusses an exemplary embodiment, in which customization system 100 is used to apply graphics to an article of clothing. In this case, the article of clothing, or simply article, may take the form of a cylindrical or tubular article, such as an athletic sock. However, it should be noted that the other embodiments could be used with any other kinds of cylindrical or tubular apparel and/or articles of clothing including, but not limited to: socks, leg sleeves, arm sleeves, armbands, wristbands, headbands, as well as individual components of apparel and/or clothing, including, but not limited to sleeves for shirts, coats, jackets, and/or sweaters, and legs for pants, shorts, and/or leggings. It will be understood that customization system 100 could be used to apply graphics to one, two, or more articles.

Customization system 100 need not be limited to use with articles of clothing; the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment. Additionally, in some embodiments, the article could be another type of article that is not configured to be worn, including, but not limited to: balls, bags, purses, backpacks, as well as other articles that may not be worn.

Customization system 100 may comprise various provisions that may be useful in applying a graphic directly to an article. In some embodiments, customization system 100 may include printer 104. Printer 104 may comprise one or more individual printers. Although a single printer is illustrated in FIG. 1, other embodiments could incorporate two or more printers that may be networked together. Printer 104 includes a print head 105 that is configured to dispense ink or other print medium onto a tubular article. Printer 104 may include one or more controllers, such as processors with associated memory, for directing print head 105 to print one or more graphics onto tubular articles. Printer 104 may be powered using conventional means, such as linking to a power grid or batteries.

In some embodiments, customization system 100 may be provided with cylinder 106 to hold a cylindrical or tubular article of clothing or apparel in a supported configuration. In the supported configuration, printer 104 may have a substantially uniform flat surface for printing onto the tubular article disposed on cylinder 106. With this arrangement, the tubular article may have a graphic printed upon it while in a similar configuration as the article is intended to be worn. Accordingly, when the printed article is placed upon the wearer's body, the graphic should appear relatively undistorted from the manner in which it was printed. Various embodiments of a customization system 100 that uses a cylinder for supporting tubular articles are disclosed in commonly-owned U.S. Patent Application Publication Number 2014/0299009, the entirety of which application is incorporated herein by reference.

Figure 3:
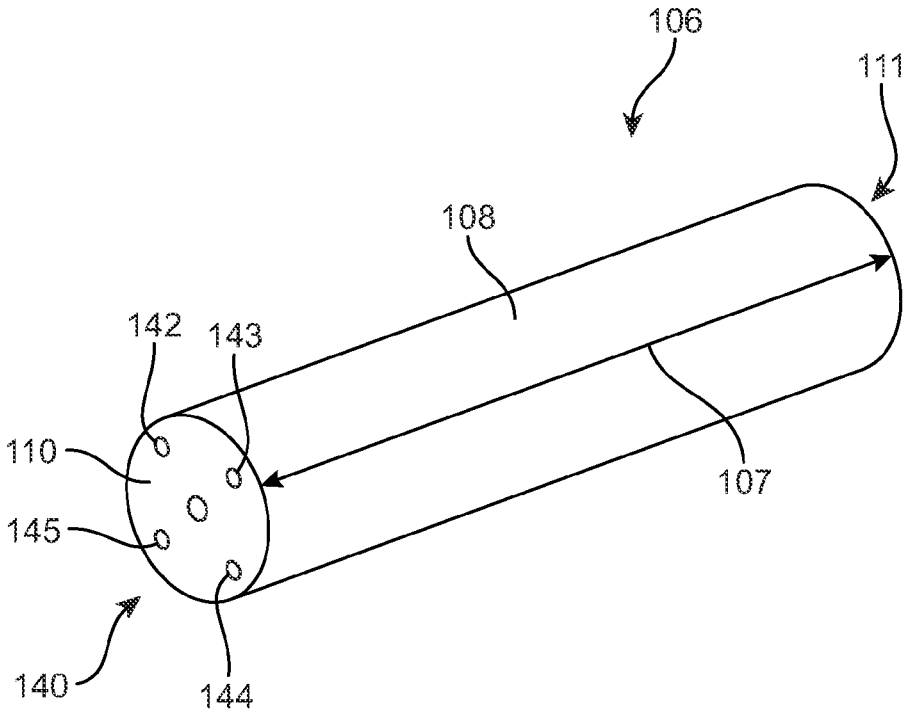
FIG. 3 is a perspective view of an embodiment of a cylinder for use in a printing system for tubular articles.

FIG. 3 shows an embodiment of cylinder 106 for use in customization system 100. Cylinder 106 generally includes a body 108 that is elongated with a length 107. In some embodiments, body 108 may be solid. In some embodiments, body 108 may be hollow. Body 108 may be an elongated member that extends between two endfaces: a first endface 110 and a second endface 111. Either or both of first endface 110 and second endface 111 may be provided with a connection system configured to receive a minimalist endcap. For example, first endface 110 may include first connection system 140. First connection system 140 may be a plurality of apertures positioned on first endface 110 in a particular pattern configured to correspond with a pattern of connectors on a removable endcap. Embodiments of the connectors on the removable endcap will be discussed in greater detail with respect to FIGS. 4-7. In the embodiment shown in FIG. 3, first connection system 140 includes a first aperture 142, a second aperture 143, a third aperture 144, and a fourth aperture 145.

Cylinder 106 may be any size known in the art to be useful for supporting tubular articles. Length 107 may be selected based upon the type of article intended to be supported. For example, length 107 of cylinder 108 may be sufficient to hold one, two, or more knee-length socks. Length 107 may be sufficient to hold one or multiple full-length sleeves for an adult shirt.

Cylinder 106 may be made of any material known in the art capable of supporting an article or articles through a printing process. In some embodiments, cylinder 106 may be essentially disposable, where cylinder 106 may be configured to support an article or articles through one, two, or a small number of printing cycles. In other embodiments, cylinder 106 may be durable so that cylinder 106 may be configured to support an article or articles through many cycles of printing, such as more than three, the lifetime of customization system 100, or the lifetimes of more than one customization systems. In some embodiments, cylinder 106 may be made of a metal material, like iron or steel. In other embodiments, cylinder 106 may be made of a thermoset or thermoplastic material, a composite material, a metal, or combinations of these materials. In some embodiments, cylinder 106 may be made of a material that will attract magnets, i.e., ferromagnetic materials. In such ferromagnetic embodiments, cylinder 106 may be made from iron or steel, or thermoset, thermoplastic, or composite materials may be doped with or otherwise contain ferromagnetic materials so that cylinder 106 may be lighter than a cylinder made entirely of a ferromagnetic material. In some embodiments, cylinder 106 may include a coating, such as a thin film of polymeric material, so that cylinder 106 may be relatively easy to clean of ink or so that cylinder 106 may readily release articles after printing.

In some embodiments, customization system 100 may include additional components for mounting various portions of customization system 100. In an exemplary embodiment, customization system 100 may include a platform 102. Platform 102 may comprise a substantially flat surface for mounting one or more components of customization system 100. In an exemplary embodiment, printer 104 and cylinder 106 may be disposed on a top side of platform 102.

In some embodiments, customization system 100, cylinder 106 may be configured to move to various positions relative to printer 104. In an exemplary embodiment, cylinder 106 may be mounted to tracks 103 of platform 102. In some cases, cylinder 106 is mounted in a movable manner to platform 102, so that cylinder 106 may slide or travel along tracks 103. This allows cylinder 106 to move between various positions along platform 102 in the direction of tracks 103 and relative to platform 102 and printer 104. In other cases, cylinder 106 may be configured to be stationary on platform 102 and printer 104 may be configured to move with respect to cylinder 106. In still other cases, printer 104 and cylinder 106 may both be configured to move with respect to each other, such as by sliding on tracks or being mounted on movable platforms. Being able to change the relative position of cylinder 106 and printer 104 may facilitate loading articles onto cylinder and removing printed articles from cylinder 106 by increasing the empty space around cylinder 106 while articles are being loaded onto and removed from cylinder 106. Then cylinder 106 may be moved to a position proximate printer 104 and print head 105 for printing. Changing the relative position of cylinder 106 and printer 104 is discussed in greater detail below with respect to FIGS. 10-15.

Printer 104 may utilize various types of printing techniques. These may include, but are not limited to: toner-based printing, liquid inkjet printing, solid ink printing, dye-sublimation printing, inkless printing (including thermal printing and UV printing) as well as any other methods of printing. In some cases, printer 104 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printer 104 may utilize an inkjet printer in which ink droplets may be sprayed onto a substrate, such as the outer surface of an article of clothing. Using an inkjet printer allows for easy variation in color and ink density. This arrangement also allows for some separation between the printer head and the target object, which can facilitate printing directly to objects with some curvature and/or surface texture.

Figure 4:
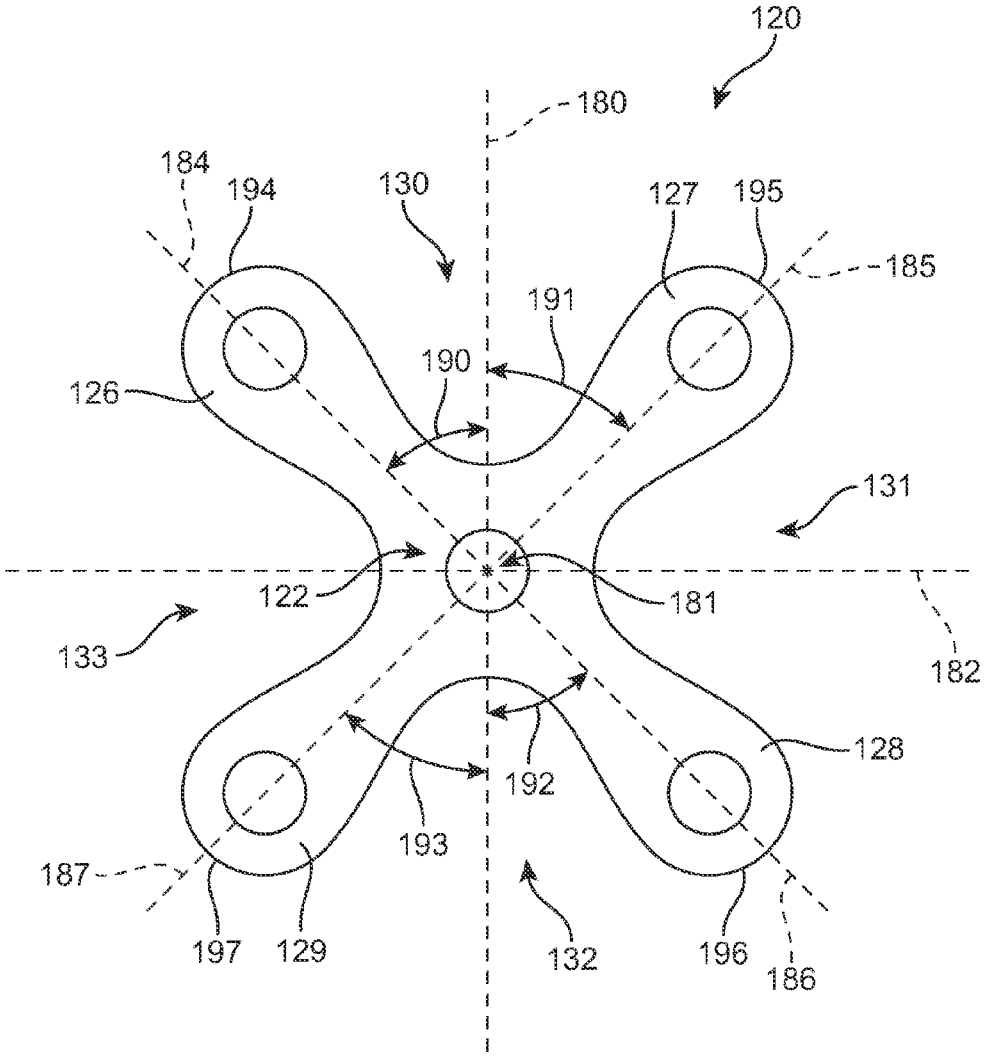
FIG. 4 is a plan view of an embodiment of an endcap for use in a printing system for tubular articles.

FIGS. 4-7 show a plan view of various embodiments of a minimalist endcap for use with cylinder 106 and customization system 100. As shown in FIG. 4, first endcap 120 may be made from any material capable of being fashioned into the minimalist geometry described herein. First endcap 120 may be made from a material sufficiently strong to support cylinder 106 though multiple printing cycles. First endcap 120 may be made from the same material as cylinder 106. First endcap 120 may be made from a durable, rigid material such as a metal, thermoset or thermoplastic materials, composite materials, or combinations of these materials. First endcap 120 may be made using any method known in the art that can achieve the minimalist geometry described herein. For example, first endcap 120 may be made by machining, forging, injection molding, compression molding, other known manufacturing techniques, or combinations of these methods.

As noted above, each minimalist endcap has a geometry designed to reduce the footprint of the endcap on cylinder 106 so that a maximized area of the tubular article may be printable space. In this embodiment, first endcap 120 minimizes its footprint on cylinder 106 with an X-shape geometry. First endcap 120 includes a centrally-disposed hub 122. Hub 122 may be a solid or uninterrupted portion of material having any perimeter geometry. In the embodiment shown in FIG. 4, hub 122 is a regular polygon with a hub center 181. In other embodiments, hub 122 may have other shapes. For reference, first endcap 120 has a vertical axis 180 that divides first endcap 120 in half vertically and a horizontal axis 182 that divides first endcap 120 in half horizontally.

In the embodiment shown in FIG. 4, to achieve the X-shape geometry, four spokes extend away from hub 122: a first spoke 126, a second spoke 127, a third spoke 128, and a fourth spoke 129. In other embodiments with different geometries, fewer spokes may be provided (such as one, two, or three spokes) or more spokes may be provided. In some embodiments, the geometry of the minimalist endcap may not support the type of spokes as shown in FIG. 4; a minimalist endcap merely utilizes a geometry where the endcap does not extend onto the body of cylinder 106 (such as body 108 shown in FIG. 3) but remains on an endface (such as first endface 110 and second endface 111) of cylinder 106 while optionally leaving portions of first endface 110 and/or second endface 11 uncovered.

In some embodiments, all spokes and the hub may be positioned at least partially in the same plane, such as the plane defined by vertical axis 180 and horizontal axis 182, so that first endcap 120 may be substantially flat on one or more sides. In other embodiments, one or more spokes may occupy a different plane than one or more of the other spokes or the hub.

Each spoke may include a distal end at the furthest distance the spoke extends away from hub 122. In the embodiment shown in FIG. 4, first spoke 126 includes a first distal end 194; second spoke 127 includes a second distal end 195; third spoke 128 includes a third distal end 196; and fourth spoke 129 includes a fourth distal end 197. Each spoke may have an axis extending from hub center 181 through a central point on that spoke's distal end. In the embodiment shown in FIG. 4, first spoke 126 has a first spoke axis 184 that extends from hub center 181 through a central point of first spoke distal end 194. Second spoke 127 has a second spoke axis 185 that extends from hub center 181 through a central point of second spoke distal end 195. Third spoke 128 has a third spoke axis 186 that extends from hub center 181 through a central point of third spoke distal end 196. Fourth spoke 129 has a fourth spoke axis 187 that extends from hub center 181 through a central point of fourth spoke distal end 197.

To define the X-shape, first spoke 126, second spoke 127, third spoke 128, and fourth spoke 129 each extend away from hub 122 at different angles. First spoke 126 extends away from hub 122 at a first spoke angle 190 defined as the angle between vertical longitudinal axis 180 and first spoke axis 184. Second spoke 127 extends away from hub 122 at a second spoke angle 191 defined as the angle between vertical longitudinal axis 180 and second spoke axis 185. Third spoke 128 extends away from hub 122 at a third spoke angle 192 defined as the angle between vertical longitudinal axis 180 and third spoke axis 186. Fourth spoke 129 extends away from hub 122 at a fourth spoke angle 193 defined as the angle between vertical longitudinal axis 180 and fourth spoke axis 186. In some embodiments, such as the embodiment shown in FIG. 4, each of first spoke angle 190, second spoke angle 191, third spoke angle 192, and fourth spoke angle 193 are substantially the same so that the X-shape is regular. In other embodiments, these angles may vary so that the X-shape may be irregular. In those embodiments where the angles vary so that the X-shape is irregular, one or more spoke may be positioned at a unique angle to act as a key for the intended placement of the endcap on the cylinder endface. For example, if an endcap has four spokes, three spokes may extend away from the hub at regular intervals while the fourth spoke may extend away from the hub at a position that is offset from the next regular interval. Therefore, the spokes may align properly with the cylinder endface only when in a single orientation.

Each spoke has a length that may be considered to be the distance between the hub center 181 and that spoke's distal end. While the length of any spoke may be any length, in some embodiments, the length of a spoke may be selected to fit inside of a perimeter of an endface of cylinder 106, such as first endface 110 or second endface 111 (shown in FIG. 3). Such a length would be beneficial in minimizing the amount of first article 101 obscured by an endcap, which effectively increases the printable surface area of first article 101. In some embodiments, the length of a spoke may be less than the radius of an endface of cylinder 106, such as first endface 110 or second endface 111. In some embodiments, the length of a spoke may be equal to or less than the radius of an endface of cylinder 106, such as first endface 110 or second endface 111.

First endcap 120 may include provisions to attach first endcap 120 to cylinder 106. In some embodiments, the provisions may be mechanical connectors, such as pins or latches. In some embodiments, the provisions may be rapid connectors, such as extensions that may be press-fitted into corresponding holes in the cylinder face. These extensions may be deformable, for example, being made from an elastomeric material. In the embodiment shown in FIG. 4, however, the rapid connectors are magnetic connectors. In embodiments where cylinder 106 and/or first endface 110 is made from a magnetically attractive material such as iron or steel, magnetic connectors can readily attach first endcap 120 to first endface 110. In the embodiment shown in FIG. 4, each spoke has a magnetic connector positioned on or near a distal end of the spoke: first spoke 126 includes a first magnetic connector 136 positioned proximate first distal end 194; second spoke 127 includes a second magnetic connector 137 positioned proximate second distal end 195; third spoke 128 includes a third magnetic connector 138 positioned proximate third distal end 196; and fourth spoke 129 includes a fourth magnetic connector 139 positioned proximate fourth distal end 197. The magnetic connectors may be attached to the distal ends of the spokes using any method known in the art, such as with adhesives, magnetic attraction, or mechanical connectors. For example, in the embodiment shown in FIG. 12, second magnetic connector 137 may be attached to second spoke 127 using a first mechanical connector 135 and third magnetic connector 138 may be attached to third spoke 128 using a second mechanical connector 141. In some embodiments, the mechanical connectors may be threaded bolts configured to be received in threaded openings that extend partially or entirely through the spokes. For example, first threaded opening 165 may extend through second spoke 127 and may receive first mechanical fastener 135. Similarly, second threaded opening 183 may extend through third spoke 128 and may receive second mechanical fastener 141. The mechanical fasteners may be permanently or removably attached to the magnetic connectors.

Though shown in FIG. 4 as generally circular in cross-section, the magnetic connectors may have any shape. The magnetic connectors may have any strength, though in some embodiments the magnetic connectors have sufficient strength to easily secure an endcap to a cylinder and hold the endcap in position when the cylinder is in use while still permitting easy removal of the endcap from the cylinder when the tubular article is ready to be removed. The connectors may be magnetic or any type of connector capable of rapid insertion and extraction from receiving provisions in a cylinder endface. These provisions are discussed below.

As shown in FIG. 3, cylinder 106 may include corresponding provisions on an endface such as first endface 110 to receive first endcap 120. In the embodiment shown in FIG. 3, first endface 110 includes multiple apertures: first aperture 142, second aperture 143, third aperture 144, and fourth aperture 145. The position of these apertures corresponds generally to the distal ends of each spoke of first endcap 120. The shape of these apertures may correspond to the shape of the magnetic connectors such as first magnetic connector 136, second magnetic connector 137, third magnetic connector 138, and fourth magnetic connector 139, so that each of the magnetic connectors may be inserted into a corresponding aperture. In the embodiment shown in FIGS. 3 and 4, both apertures (first aperture 142, second aperture 143, third aperture 144, and fourth aperture 145) and magnetic connectors (first magnetic connector 136, second magnetic connector 137, third magnetic connector 138, and fourth magnetic connector 139) are circular in cross-section. This allows for the magnetic connectors to be inserted into a corresponding aperture. The insertion of the magnetic connectors into a corresponding aperture may assist in holding endcap in position while cylinder 106 is rotating: both magnetic and mechanical connections will inhibit any relative movement of first endcap 120 with respect to first endface 110. An embodiment of the attachment of first endcap 120 to first endface 110 of cylinder 166 is discussed in greater detail below.

The X-shape geometry of first endcap 120 includes gaps between the spokes to remove material from first endcap 120. This removal of material may reduce the weight of first endcap 120 and to provide additional gripping surfaces so that first endcap 120 may be easier to manipulate. For example, first endcap 120 may be easier to remove from cylinder 106 than a solid endcap. Such gaps would be beneficial in minimizing the amount of first article 101 obscured by an endcap, which effectively increases the printable surface area of first article 101. In the embodiment shown in FIG. 4, each spoke has an edge separated from an adjacent spoke edge by a gap. For example, first spoke 126 is separated from second spoke 127 by a first gap 130. Similarly, first spoke 126 is separated from fourth spoke 129 by a fourth gap 133. Second spoke 127 is separated from third spoke 128 by a second gap 131, and third spoke 128 is separated from fourth spoke 129 by a third gap 132. In the embodiment shown in FIG. 4, each gap is continuous between adjacent spokes. In other embodiments, one or more gaps may be discontinuous, as portions of spoke material may extend across gaps, such as for additional structural support for certain materials or thicknesses of a minimalist endcap.

The geometry of each spoke includes the shape along the length of the spoke and a distal end shape. For example, these shapes may be smooth and rounded, such as shown in FIG. 4, to be ergonomic. Having a rounded or curved distal end like first spoke distal end 194 may also be beneficial in inhibiting snagging of the spoke on the tubular article.

Figure 5:
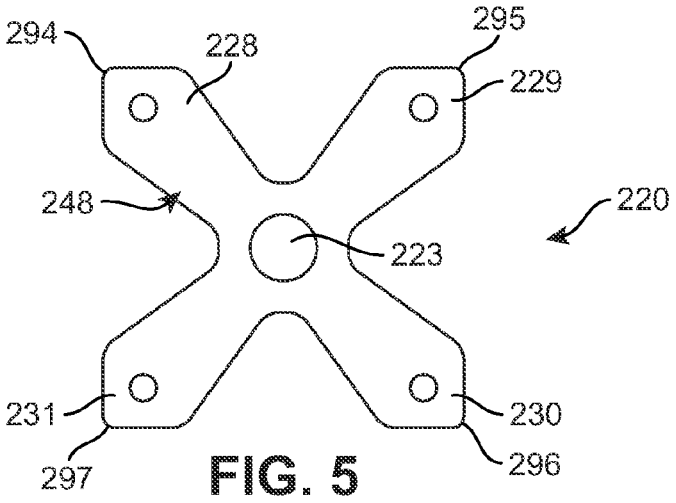
FIG. 5 is a plan view of another embodiment of an endcap for use in a printing system for tubular article having an alternate spoke geometry.
Figure 6:
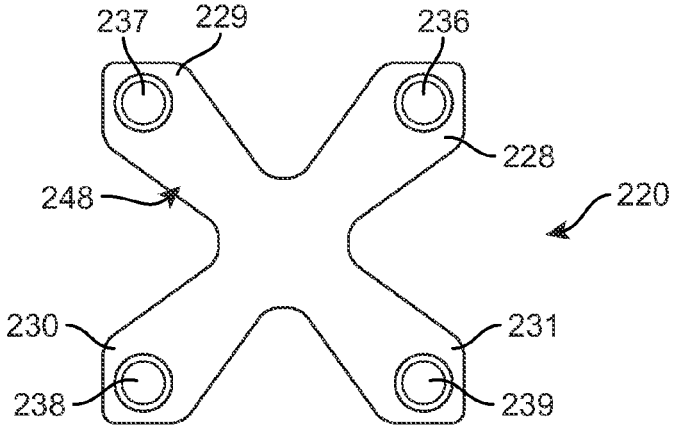
FIG. 6 is a plan view of an obverse side of the endcap of FIG. 5.
Figure 7:
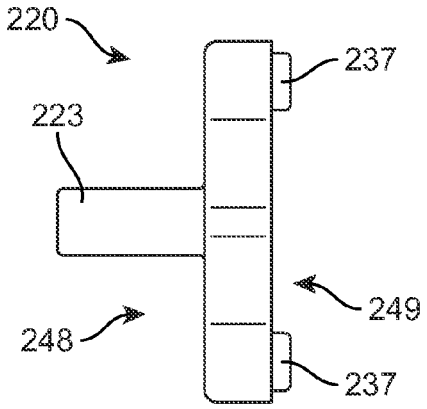
FIG. 7 is a side view of the endcap of FIG. 5.

However, in other embodiments, the geometry of each or any spoke may be different. FIGS. 5-7 show another embodiment of an alternate endcap 220 with an X-shape but different spoke geometry from first endcap 120 shown in FIG. 4. Alternate endcap 220 is similar in most respects to first endcap 120: four spokes, first alternate spoke 228, second alternate spoke 229, third alternate spoke 230, and fourth alternate spoke 231, radiate outward from a central alternate hub. Each spoke includes a distal end: in the embodiment shown in FIGS. 5-7, first alternate spoke 228 includes a first alternate distal end 294; second alternate spoke 229 includes a second alternate distal end 295; third alternate spoke 230 includes a third alternate distal end 296; and fourth alternate spoke 231 includes a fourth alternate distal end 197. Unlike the embodiment shown in FIG. 4, first alternate distal end 294, second alternate distal end 295, third alternate distal end 296, and fourth alternate distal end 197 each have a pointed configuration. The pointed distal ends of the spokes of endcap 220 of FIGS. 5-7 may be beneficial in holding the tubular article in position while endcap 220 is being placed onto a cylinder endface. The pointed distal ends of the spokes of endcap 220 may also be easier to manufacture than other geometries.

In many respects, however, alternate endcap 220 may be similar to first endcap 120. Though discussed with respect to alternate endcap 220, the following features may be the same whether present in first endcap 120 and alternate endcap 220. As shown in FIGS. 5-7, alternate endcap 220 includes a first side 248 (FIG. 5) and a second or obverse side 249 (FIG. 6). Alternate axle 223 may extend away from alternate hub from first side 248. In some embodiments, alternate axle 223 may be integrally formed with alternate endcap 220. In other embodiments, axle 223 may be formed separately from the rest of endcap 220 and attached to endcap 220. In some embodiments, axle 223 may extend away from first side 248 at an angle with respect to the spokes. In some embodiments, axle 223 may extend away from first side 248 substantially perpendicular to the spokes.

In some embodiments, first side 248 may be intended to be oriented towards mount 116 when cylinder 106 is in use in customization system 100 so that alternate axle 223 may rest in cradle 119 (shown in FIG. 1). In such embodiments, second side 249 may be intended to be oriented towards first endface 110 (shown in FIG. 3) of cylinder 106. In such embodiments, therefore, magnetic connectors such as first alternate magnetic connector 236, second alternate magnetic connector 237, third alternate magnetic connector 238, and fourth alternate magnetic connector 239 may be positioned on and extend away from second side 249. The different features of the different sides of alternate endcap 220 are clearly shown in FIG. 7, where alternate axle 223 is shown as extending away from first side 248 and second alternate magnetic connector 237 and third alternate magnetic connector 238 are shown as extending in the opposite direction away from second side 249.

Figure 8:
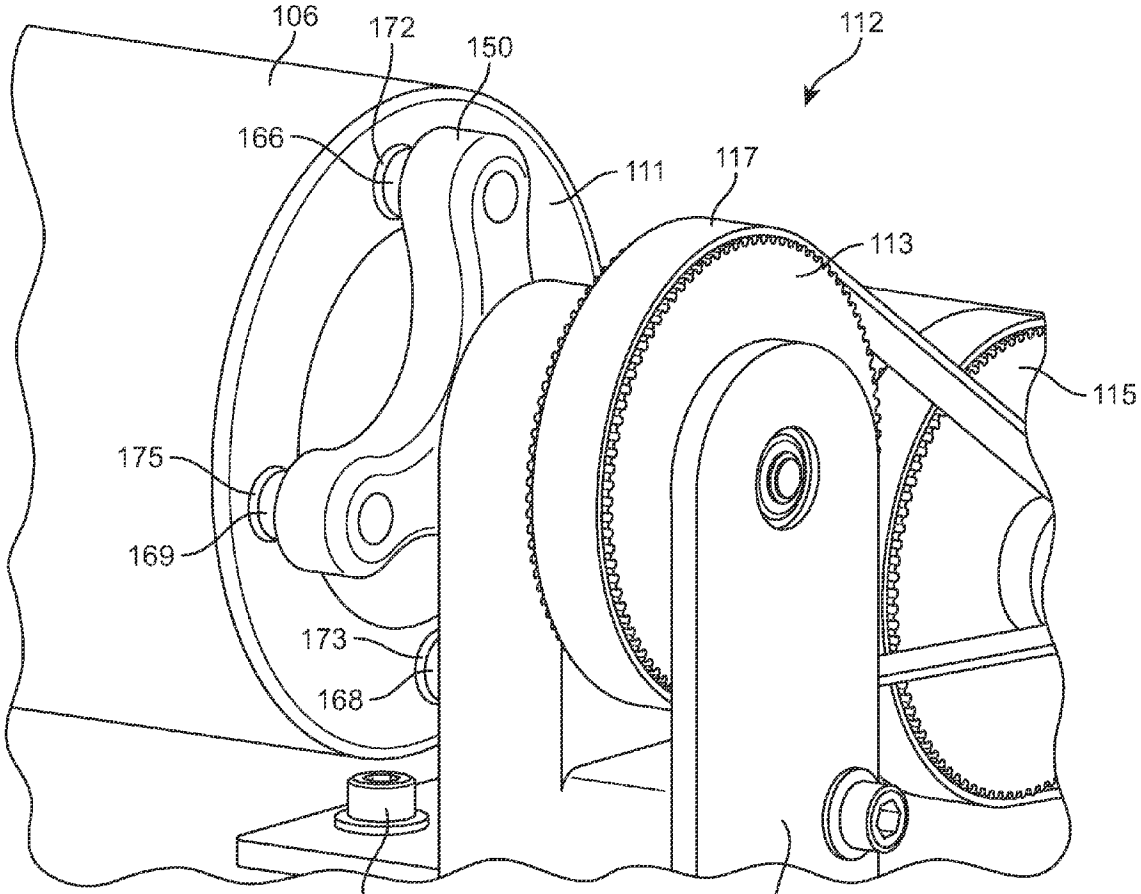
FIG. 8 is a perspective view of an embodiment of a drive mechanism for a cylinder for a printing system for tubular articles, where an endcap is integrated into the drive mechanism.

In some embodiments, customization system 100 may be provided with an apparatus configured to circumferentially rotate cylinder 106, such as cylinder drive system 112. In an exemplary embodiment, customization system 100 may include embodiments of cylinder drive system 112 that includes components that are attached to customization system 100 and configured to circumferentially rotate cylinder 106. In some embodiments, such as the embodiment shown in FIG. 1, a cylinder drive mount 114 may be a rigid structure or device that is attached to platform 102. Cylinder drive mount 114 may be mounted and configured to slide or translate within tracks 103. As shown in FIGS. 1 and 8, cylinder drive mechanism 112 may include a belt-driven system to rotate cylinder 106, where a belt 117 extends between a first gear 113 and a second gear 115. In one embodiment, cylinder 106 may rest on top of rollers 114 above cylinder drive mount 114. In cases where printer 104 is configured to move while stationary platform 108 remains in place, cylinder drive mount 114 translates the linear movement of printer 104 along tracks 103 into rotational movement of cylinder 106. Rollers 114 in contact with stationary platform 108 rotate when printer 104 moves along tracks 103. The rotation of rollers 114 is then transferred to cylinder 106, which is in contact with rollers 114 above cylinder drive mount 114. With this arrangement, cylinder 106 may be circumferentially rotated to allow for printing over the exterior surface of an article when disposed on cylinder 106. Such a roller-based system is described in U.S. Patent Application Publication 2014/0299009, which application has been incorporated by reference.

In other embodiments, a different arrangement may be provided to rotate cylinder 106. For example, in some cases, cylinder 106 may be rotated using a rack and pinion arrangement to translate the linear motion of printer 104 and/or a movable platform into rotational motion of cylinder 106. In other embodiments, cylinder 106 may be rotated using an actuator motor that turns a gear or chain drive to rotate cylinder 106. In addition, various other devices may be used as is known in the art to rotate cylinder 106.

Figure 9:
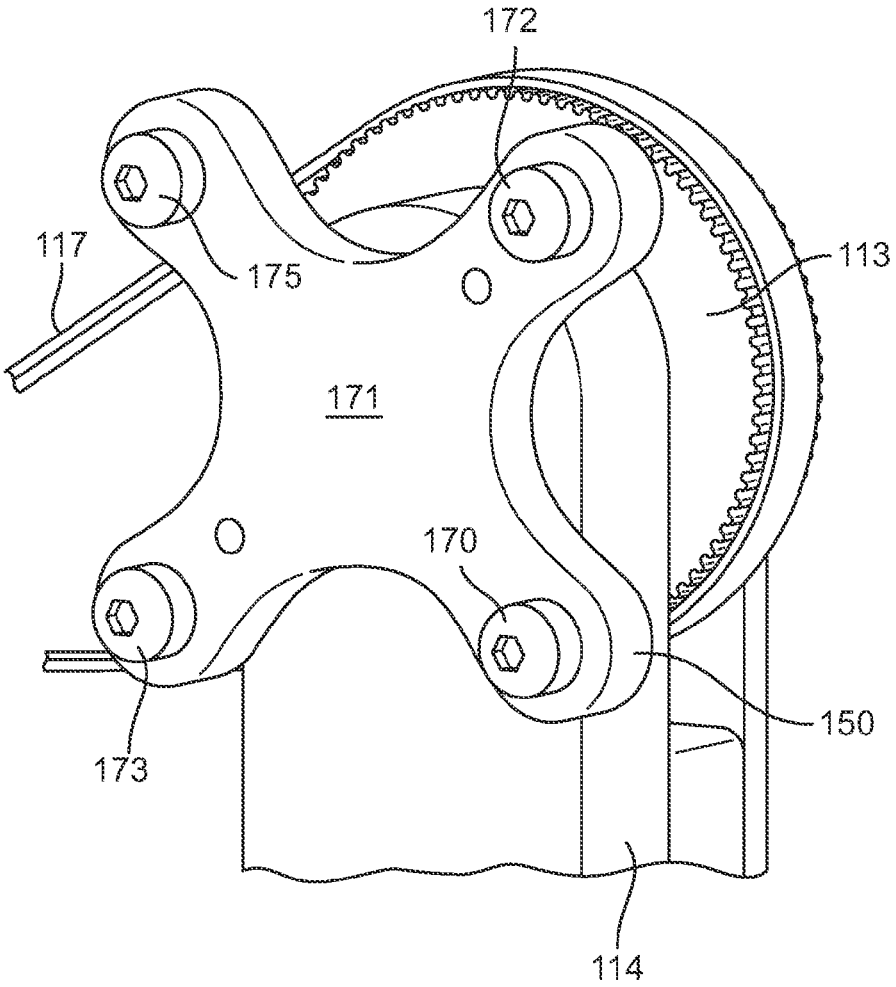
FIG. 9 is a perspective view of the drive mechanism of FIG. 8.

In some embodiments, one or both minimalist endcaps may be integrated into printing system, such as into the mounting portions for cylinder 106, such as cylinder mount 116 and/or cylinder drive mechanism 112. FIGS. 8-9 show an embodiment of a second minimalist endcap 150 where second endcap 150 is integrated into cylinder drive mechanism 112 so that a second endcap second side 171 may be oriented to receive cylinder 106.

As shown in FIGS. 1, 8, and 9, cylinder drive mechanism 112 may include a cylinder drive mount 114. Cylinder drive mount 114 may be any type or shape of mount capable of supporting both the drive mechanism 112 and cylinder 106 during the rotational operation of cylinder 106. Cylinder drive mount 114 may be attached or connected to platform 102, such as with a fastener 155. Cylinder drive mount 114 may be configured to translate with respect to platform 102, such as by sliding within track 103. In some embodiments, cylinder drive mount 114 may be a metal mount, while in other embodiments, cylinder drive mount 114 may be made of any other material known in the art, such as thermoset or thermoplastic materials, composite materials, ceramic materials, elastomeric materials, and combinations of these materials.

A first gear 113 and a second gear 115 may be rotatably associated with cylinder drive mount 114. First gear 113 and second gear 115 may be any type or size of gear known in the art. The selection of first gear 113 and second gear 115 may depend upon factors such as the rate of rotation of cylinder, the size and weight of cylinder 106, and the type of motor for driving the gears, such as motor 118 (shown in FIG. 1). In some embodiments, first gear 113 and second gear 115 may be the same size and/or type of gear. In other embodiments, first gear 113 and second gear 115 may be different sizes and/or types of gears. In other embodiments, either the size of first gear 113 and second gear 115 or the type of first gear 113 and second gear 115 may be the same.

A motor 118 may be attached to cylinder drive mount 114 and may be linked to at least one of first gear 113 and second gear 115 to cause the rotation of the linked gear. In the embodiment shown in FIGS. 8 and 9, motor 118 is configured to drive first gear 113. Motor 118 may be any type of motor known in the art capable of producing sufficient torque to drive cylinder 106, such as an electric, hydraulic, or pneumatic motor or a constant torque motor. A belt 117 may extend between first gear 113 and second gear 115 to modulate and smooth the rotation of the gears. Belt 117 may be any type of belt known in the art, such as a rubber, fabric, metal, composite, textured, or smooth belt or combinations of these types of belts. Further, if only first gear 113 is driven by motor 118, belt 117 imparts the rotation of first gear 113 to second gear 115.

As shown in FIGS. 8 and 9, second endcap 150 may be attached directly to drive mount 114 so that second axle 121 (shown in FIG. 1) may be directly and permanently attached to first gear 113, second gear 115, or another part of drive mount 114. In the embodiment shown in FIGS. 8 and 9, second endcap 150 is connected to first gear 113. In some embodiments, second endcap 150, second axle 121, and first gear 113 may be integrally formed so that second endcap 150 may be an extension of first gear 113. In some embodiments, second endcap 150 second axle 121 may be integrally formed like first endcap 120 and first axle 123 discussed above. In some embodiments, each of first endcap, second axle 121, and first gear 113 may be separately formed and subsequently attached to each other to form the configuration shown in FIGS. 1, 8, and 9. Second axle 121 may be attached, such as removably or permanently, to first gear 113 so that the rotation of first gear 113 may still transfer to rotate endcap 150 without slippage or with controlled or minimal slippage between first gear 113 and second axle 121.

Having an endcap 150 integrated with cylinder drive mechanism 112 may be beneficial in both the loading of cylinder 106 into customization system 100 and while cylinder 106 is being driven during operation of customization system 100. For example, during the loading of cylinder 106, which is described in further detail below, a technician may align the magnetic connectors of the endcap with the apertures on an endface of the cylinder. For example, as shown in FIG. 8 in an already loaded position, second endcap first magnetic connector 166 of second endcap 150 may be aligned with second endface first aperture 172 on second endface 111 of cylinder 106. Similarly, second endcap third magnetic connector 168 may be aligned with second endface third aperture 173, and second endcap fourth magnetic connector 169 may be aligned with second endface fourth aperture 175. Aligning the magnetic connectors with the endface apertures may be simplified for a technician or an automated system if the magnetic connectors are held securely in one orientation by drive mount 114. Otherwise, a technician or an automated system may be required to manipulate both cylinder 106 and second endcap 150 simultaneously. Such simultaneous manipulation may prove difficult, especially if cylinder 106 is heavy or if the tubular article(s) on cylinder 106 are to be maintained in a specific alignment on cylinder 106. Having drive mount 114 support one of the mechanisms would relieve the technician or automated system of part of the alignment and/or support burden while loading cylinder 106 into customization system 100.

Further, if second endcap 150 is integrated into the drive mechanism, the transfer of rotation from drive mechanism 112 to endcap 150 and cylinder 106 may be more efficient than if second endcap 150 were to be attached to drive mechanism 112 every time cylinder 106 is loaded into customization system 100. Improper attachment and any resultant slippage could be avoided with a permanent connection between drive mechanism 112 and second endcap 150. Even if the attachment were correct, slippage between drive mechanism 112 and second endcap 150 may result from any impermanent connection, as any impermanent connection may not be as secure as a permanent connection. Further, wear and tear on the attachment portion between the gears 113 and 115 and second endcap 150, such as axle 121, may be minimized so that the attachment, and therefore, the transfer of the rotation of the gears 113 and 115 to second endcap 150 remains unchanged and/or predictable over the lifetime of customization system 100.

FIGS. 10-15 show an embodiment of how a printing system, such as customization system 100, may incorporate a cylinder, such as cylinder 106, with a minimalist endcap, such as first endcap 120 and second endcap 150, to print a tubular article, such as first article 101 and second tubular article 201.

Figure 10:
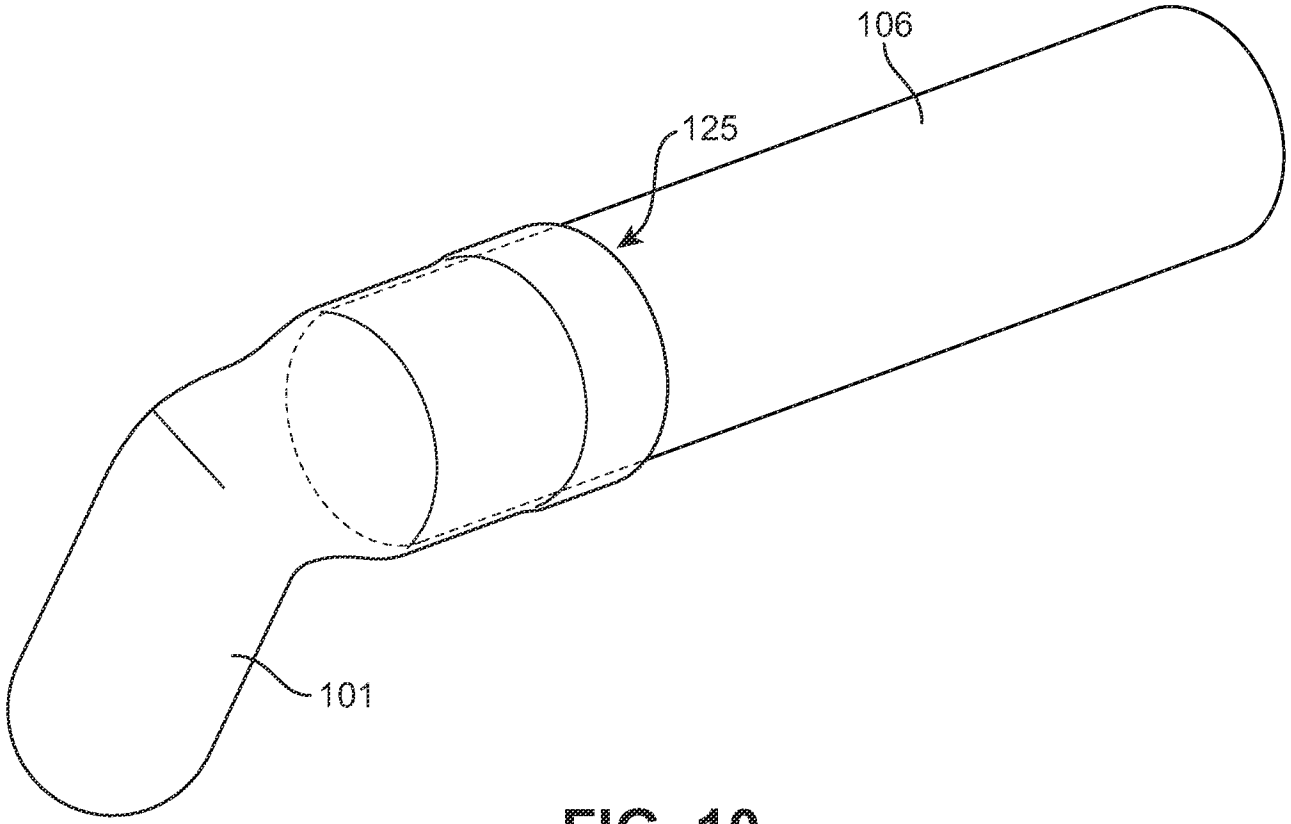
FIGS. 10-15 show an embodiment of how to use an embodiment of a printing system for tubular articles including a cylinder and removable minimalist endcaps.
Figure 13:
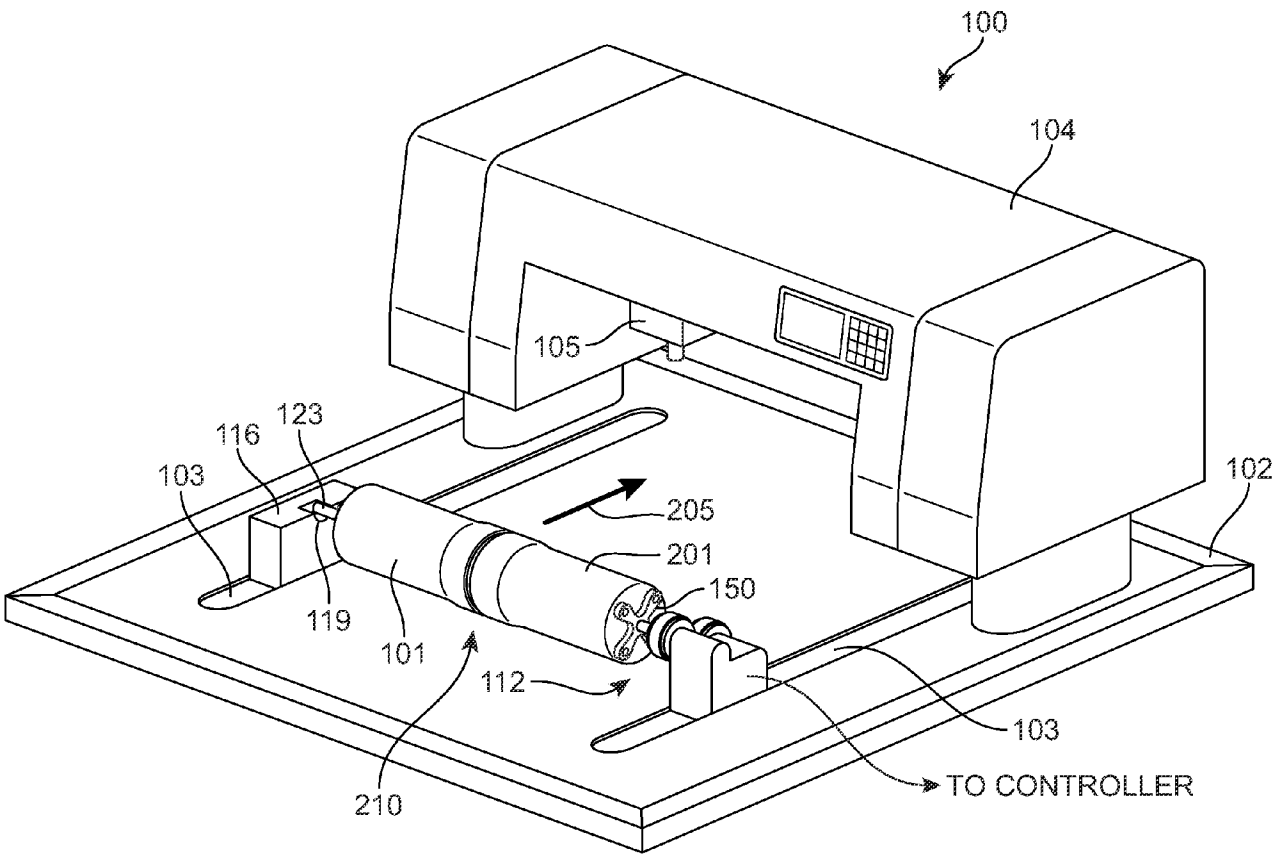
Figure 14:
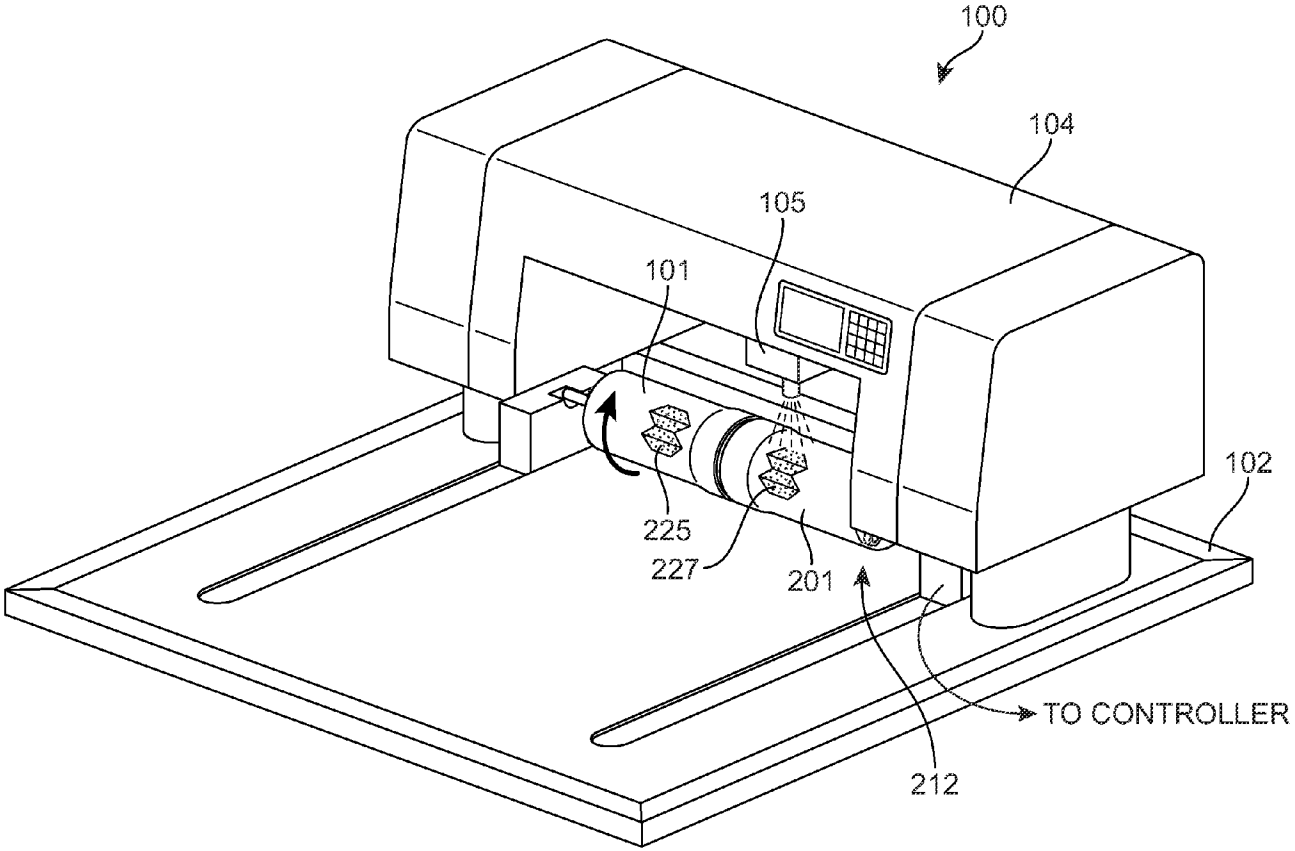
Figure 15:
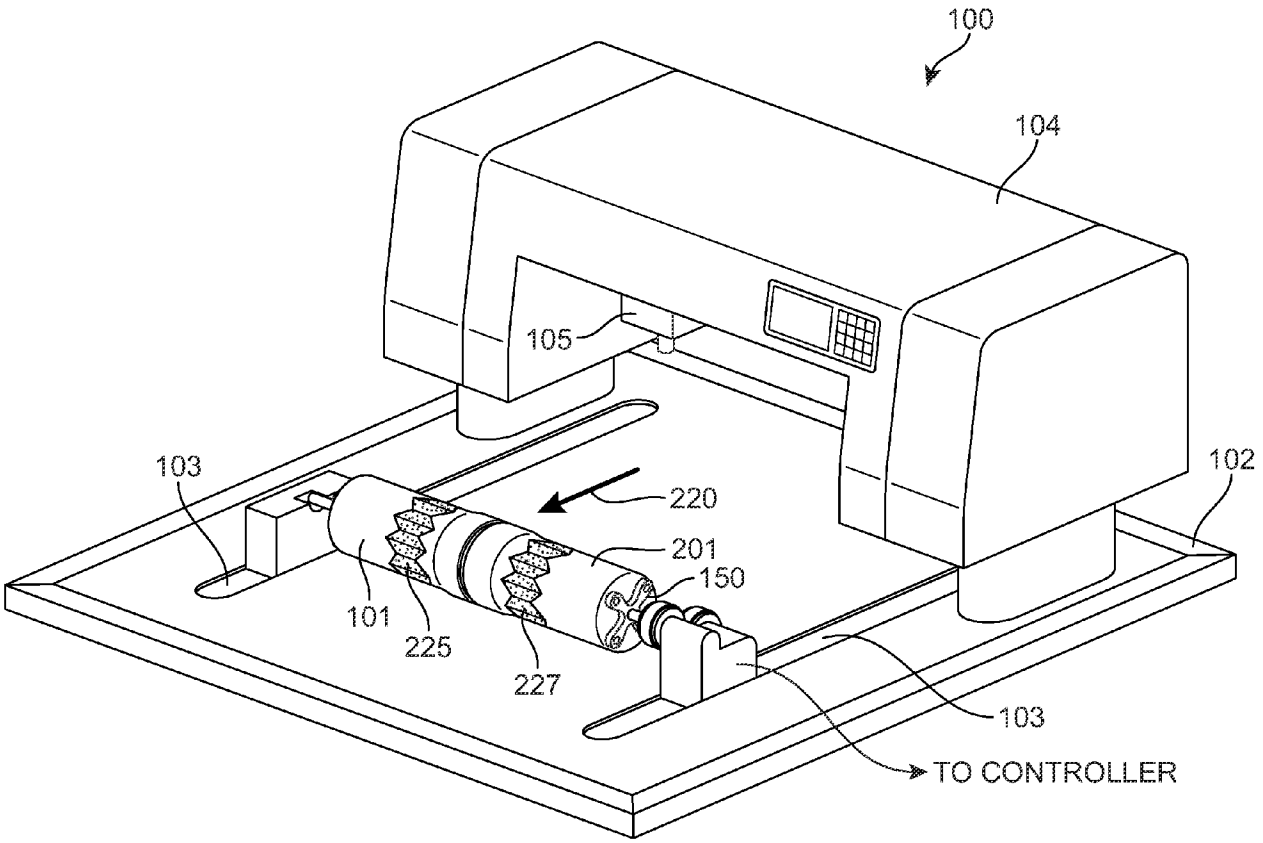

An embodiment of a first step of an embodiment of a method of using a minimalist endcap in conjunction with a cylinder for printing onto a tubular article is shown in FIG. 10. In this embodiment, a first article 101 is a sock. First article 101 has an open end with a leading edge 125. First article 101 may be positioned on cylinder 106 by stretching the open end and inserting cylinder 106 into the interior of first article 101. First article 101 is then pulled onto cylinder 106 until leading edge 125 is in a desired position, such as in a center of a length of cylinder 106. By reaching only halfway along the length of cylinder 106, two tubular articles may be positioned on a single cylinder for simultaneous printing as shown in FIGS. 13-15. For example, a pair of socks may be printed at the same time on a single cylinder.

Figure 11:
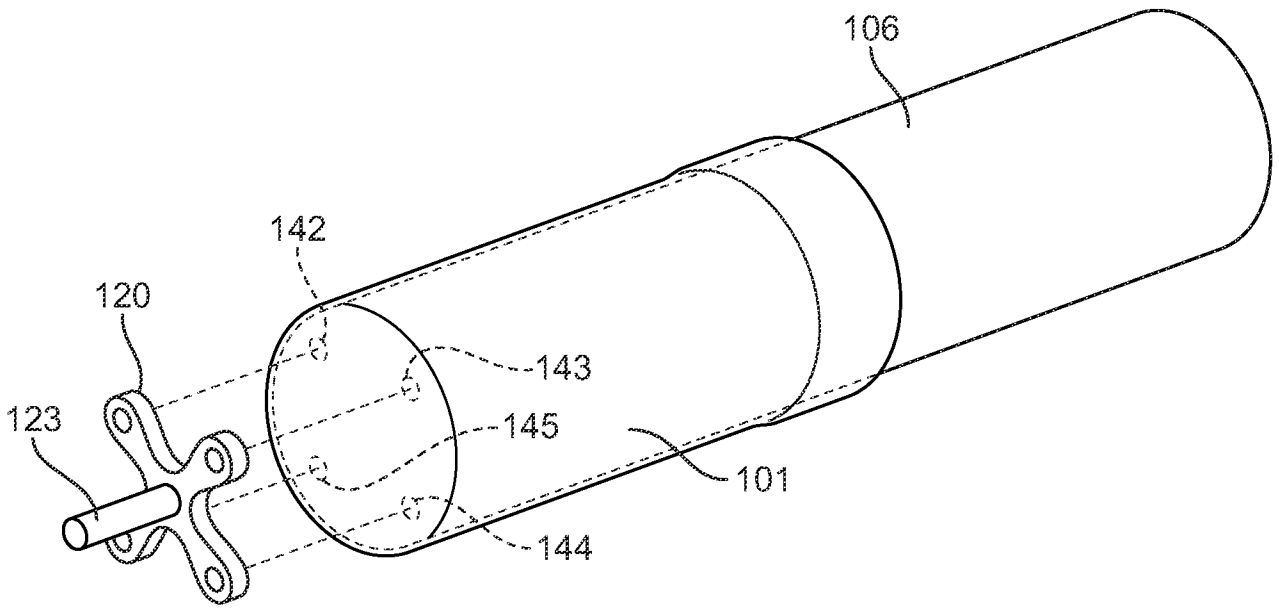
Figure 12:
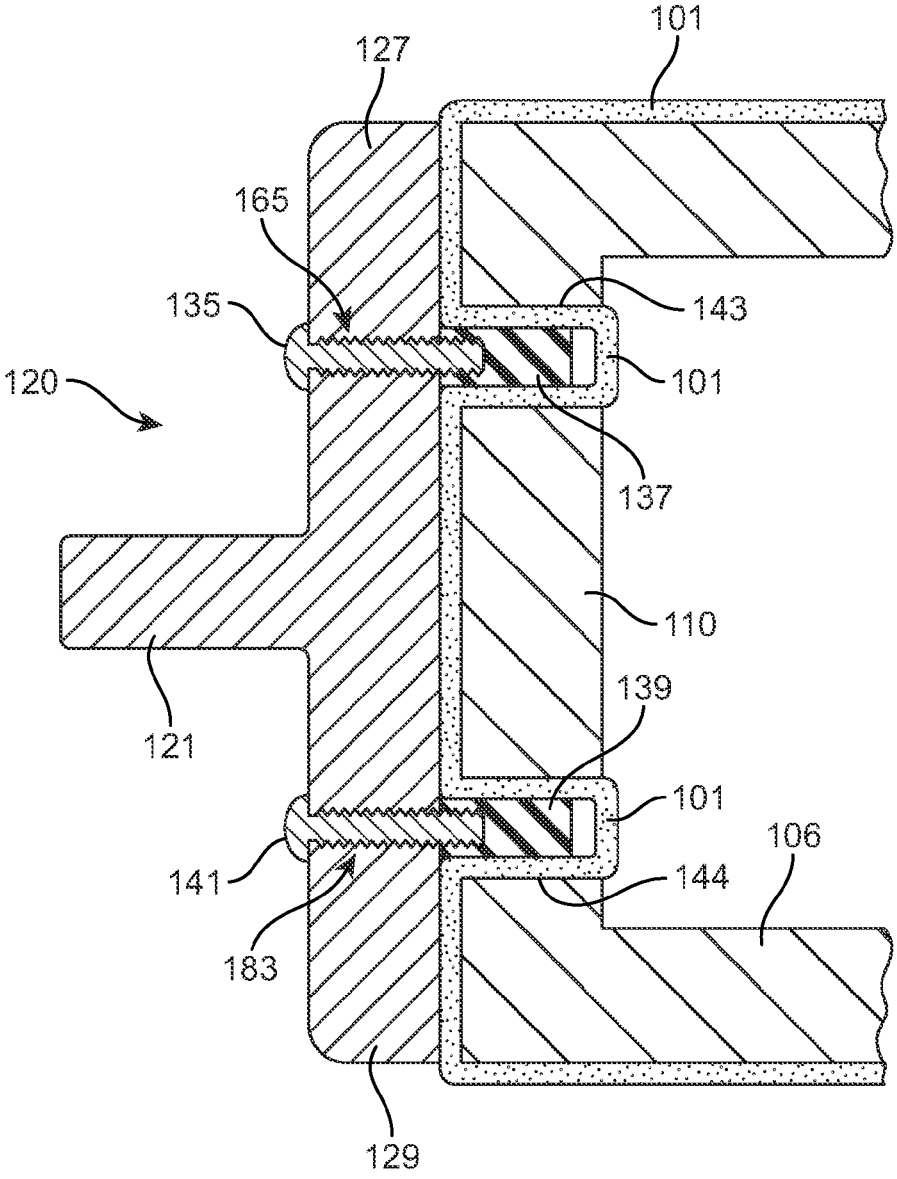

FIGS. 11 and 12 show an embodiment of a second step of an embodiment of a method of using a minimalist endcap in conjunction with a cylinder for printing onto a tubular article: attaching the minimalist endcap to the cylinder. As shown in FIG. 11, first endcap 120 may be aligned with cylinder 106 facing first endface 110 so that first magnetic connector 136 aligns with first aperture 142, second magnetic connector 137 aligns with second aperture 143, third magnetic connector 138 aligns with third aperture 144, and fourth magnetic connector 139 aligns with fourth aperture 145. As shown in both FIGS. 11 and 12, first endcap 120 is positioned so that first endcap axle 123 extends away from cylinder 106.

FIG. 12 shows a cross-sectional view of an embodiment of first endcap 120 in position on cylinder 106. As shown in FIG. 12, first article 101 is trapped between first endcap 120 and cylinder 106 when first article 101 and first endcap 120 are loaded onto cylinder 106. The cross-section shows second spoke 127 with second magnetic connector 137 extending into cylinder 106 through second aperture 143 and third spoke 128 with third magnetic connector 138 extending into cylinder 106 through third aperture 144. Portions of first article 101 are pushed into and held within second aperture 143 and third aperture 144 by, respectively, second magnetic connector 137 and third magnetic connector 138. In this manner, first article 101 is trapped between first endcap 120 and cylinder 106 to securely hold first article 101 on cylinder 106 in a stable printing position even as cylinder 106 rotates. Similarly, because each magnetic connector is inserted into an aperture and may extend into an interior of cylinder 106, the connection between cylinder 106 and first endcap 120 remains secure even while cylinder 106 is rotating. The magnetic connectors may allow for rapid loading and securing of articles onto cylinder 106, as the endcaps may be quickly positioned on cylinder 106 to secure articles onto cylinder 106.

An embodiment of another step of an embodiment of a method of using a minimalist endcap in conjunction with a cylinder for printing onto a tubular article is shown in FIG. 13: loading cylinder into customization system 100. In FIG. 13, customization system 100 is shown with cylinder 106 in a load position 210, where cylinder 106 is spaced apart from printer 104 and print head 105 so that a technician or automated system (such as a robot arm) has sufficient space to manipulate cylinder 106. Cylinder 106 has first article 101 and second tubular article 201 positioned back-to-back on cylinder 106, as first article 101 and second tubular article 201 have been positioned on cylinder 106 in a previous method step, such as the steps shown in FIGS. 10 and 11. Cylinder 106 has been attached to customization system 100. In this embodiment, first axle 123 of first endcap 120 rests in cradle 119 of cylinder mount 116 so that first axle 123 may freely rotate within cradle 119. Second endcap 150 may be integrated into cylinder drive system 112 as shown in FIGS. 8 and 9, discussed above, where second axle 121 may rotate with respect to drive mount 114 as driven by cylinder drive mechanism 112 such as first gear 113, second gear 115, belt 117, and motor 118. In this embodiment, cylinder 106 is configured to translate within track 103 to be moved into a printing or use position by traveling in a load-to-use direction 205. The movement of cylinder 106 may be directed using any known method, such as by a controller such as a processor with memory containing a printing program. For example, cylinder 106 may be moved by a controller triggering a motor attached to cylinder drive mechanism 112.

An embodiment of another step of an embodiment of a method of using a minimalist endcap in conjunction with a cylinder for printing onto a tubular article is shown in FIG. 14: printing a graphic or graphics on tubular articles 101 and 201. A shown in FIG. 14, cylinder 106 is now in a use position 212 where cylinder 106 is positioned proximate printer 104 and print head 105. Cylinder 106 rotates in a rotation direction 224 to expose different portions of the printing surfaces of first article 101 and second tubular article 201 in a proscribed fashion. The rotation of cylinder 106 may be controlled in any known fashion, such as by a controller, such as a processer with a memory containing a printing program. Printer 104 may be configured to print a first graphic 225 onto first article 101 and a second graphic 227 onto second tubular article 201. For example, printer 104 may contain memory with a programmed graphic or printer 104 may be attached to a remote input or source for a programmed graphic. In some embodiments, first graphic 225 may be the same as second graphic 227. In other embodiments, first graphic 225 may be different from second graphic 227.

An embodiment of another step of an embodiment of a method of using a minimalist endcap in conjunction with a cylinder for printing onto a tubular article is shown in FIG. 15: moving cylinder 106 back to a load position to remove first article 101 and second tubular article 201 from cylinder 106. FIG. 15 shows cylinder 106 in load position, having been translated in tracks in use-to-load direction 222. In this position, cylinder 106 is spaced apart from printer 104 and print head 105 to allow a technician or automated system to remove first article 101 and second tubular article 201 from cylinder 106, such as by sliding first article 101 and second tubular article 201 off of cylinder 106. To facilitate the removal of first article 101 and second tubular article 201 from cylinder 106, first endcap 120 and second endcap 150 may be disconnected from cylinder so that first article 101 and second tubular article 201 are no longer trapped between the endcaps and cylinder 106. The disconnection of the endcaps from cylinder 106 may be readily achieved by simply pulling on the endcaps with sufficient force to detach the magnetic connectors from the endface apertures. First endcap 120 may be removed by lifting first axle 123 cradle 119 and pulling on first endcap 120 with sufficient force to overcome the magnetic attraction between the magnetic connectors and cylinder 106 and to extract the magnetic connectors from the apertures on the cylinder endface, such as extracting second magnetic connector 137 from second aperture 143 from first endface 110. Similar force may be used to pull cylinder 106 off of integrated second endcap 150. Such a force may not occur during the rotational operation of cylinder 106 in customization system 100 or when cylinder 106 is translating along track 103. However, such a force may be readily and quickly applied by a technician or an automated system programmed to remove endcap 120 from cylinder 106 for rapid unloading of the articles from cylinder 106. In some embodiments, first endcap 120 may be removed from cylinder 106 before second endcap 150 is removed from cylinder 106. In other embodiments, second endcap 150 may be disconnected from cylinder 106 before first endcap 120 is disconnected from cylinder 106. In some embodiments, cylinder mount 116 may detach from platform 102 to facilitate the removal of cylinder 106 from customization system 100.

Persons of skill in the art will recognize variations of customization system 100 using a minimalist endcap such as endcaps 120 and 150 in conjunction with a cylinder such as cylinder 106 for printing onto a tubular article. For example, in some embodiments, printer 104 may be configured to move with respect to cylinder 106 by translating within tracks 103. In other embodiments, second endcap 150 may be identical or similar to first endcap 120 instead of being integrated into cylinder drive mechanism 112. In such embodiments, second axle 121 may be attached to cylinder drive mechanism 112 in such a way that cylinder drive mechanism 112 may drive cylinder 106 via second axle 121. For example, second axle 121 may lock into an aperture or other latching mechanism configured to securely but removably attach second axle to first gear 113 or second gear 115 so that the rotation of the gear is transferred to second axle 121. In such embodiments, second axle 121 may be square or non-circular in cross-sectional shape to facilitate the secure attachment and to minimize slippage of second axle 121 within the latching mechanism. In other embodiments, cylinder 106 may be configured to receive one, two, or more than two tubular articles at the same time. Further, in some embodiments, only one endcap may be removable, such as in those embodiments where only one article is to be printed.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A removable endcap for a cylinder, the endcap having a first surface configured to face the cylinder and a second, opposite surface, the endcap comprising:

a central hub;

at least one spoke extending away from the central hub;

at least one rapid connector attached to the first surface of the endcap, wherein the at least one rapid connector is attached proximate a distal end of the at least one spoke.

2. The endcap according to claim 1, wherein a plurality of spokes extend away from the central hub, and wherein each spoke of the plurality of spokes includes a rapid connector.

3. The endcap according to claim 2, wherein the plurality of spokes are evenly distributed around a perimeter of the central hub.

4. The endcap according to claim 2, wherein the endcap has an X-shape.

5. The endcap according to claim 2, wherein each spoke in the plurality of spokes extends away from the central hub at a different angle.

6. The endcap according to claim 1 further comprising an axle extending away from the second surface of the endcap at the central hub.

7. A printing system for customizing a tubular article, the printing system comprising:

a platform;

a printer mounted onto the platform;

a cylinder removably mounted to the platform, the cylinder configured to hold the tubular article; and an endcap configured to be attached to an end of the cylinder, the endcap comprising a hub, at least one spoke extending away from the hub, and a magnetic connector disposed on the at least one spoke.

8. The printing system according to claim 7 further comprising a drive mechanism that is configured to rotate the cylinder.

9. The printing system according to claim 8, wherein the drive mechanism supports the cylinder above the platform.

10. The printing system according to claim 8, wherein the endcap is permanently attached to the drive mechanism.

11. The printing system according to claim 7, wherein the cylinder includes an aperture formed into an end face of the cylinder, and wherein the magnetic connector is disposed within the aperture when the endcap is positioned on the cylinder.

12. The printing system according to claim 7, wherein the cylinder has a length sufficient to receive multiple articles for printing.

13. The printing system according to claim 7, wherein the endcap includes an axle that extends away from the hub, wherein the axle is substantially perpendicular to the at least one spoke.

14. A printing system for customizing a tubular article, the printing system comprising:

a platform;

a printer mounted onto the platform, the printer including a print head;

a cylinder removably mounted to the platform, the cylinder configured to hold the tubular article and to position the tubular article proximate the print head;

a first endcap configured to be attached to a first end of the cylinder; and a second endcap configured to be attached to a second end of the cylinder, wherein each endcap comprises a hub, at least one spoke extending away from the hub, and a magnetic connector disposed on the at least one spoke.

15. The printing system according to claim 14 further comprising a drive mechanism, wherein the drive mechanism is positioned proximate the first end of the cylinder, and wherein the first endcap is permanently attached to the drive mechanism.

16. The printing system according to claim 15, wherein the second endcap includes an axle that extends away from the hub of the second endcap, wherein the axle is substantially perpendicular to the spoke of the second endcap.

17. The printing system according to claim 16, wherein the axle is configured to be removably associated with the platform.

18. The printing system according to claim 14, wherein the first end of the cylinder includes an aperture, and wherein the magnetic connector of the first endcap is disposed within the aperture when the first endcap is positioned on the cylinder.

19. The printing system according to claim 14, wherein the second end of the cylinder includes an aperture, and wherein the magnetic connector of the second endcap is disposed within the aperture when the second endcap is positioned on the cylinder.

* * * * *